US005526593A

United States Patent [19]

Coppage

[11] Patent Number: 5,526,593

[45] Date of Patent: Jun. 18, 1996

[54] REPLACEABLE ADAPTER FOR EXCAVATING CUTTERHEAD

[75] Inventor: Kenneth F. Coppage, Daphne, Ala.

[73] Assignee: Mobile Pulley & Machine Works, Inc., Mobile, Ala.

[21] Appl. No.: 275,448

[22] Filed: Jul. 15, 1994

[51] Int. Cl.[6] ..... E02F 9/28; E02F 3/88

[52] U.S. Cl. ..... 37/452; 37/446; 299/113

[58] Field of Search ..... 37/328, 450, 452, 37/453, 454, 455, 456, 446; 299/7, 90, 91, 113

[56] References Cited

U.S. PATENT DOCUMENTS 3,808,716 5/1974 Verbeek ..... 37/452 X
4,470,210 9/1984 Hahn ..... 37/452
4,872,274 10/1989 Giersch et al. ..... 37/446 X
4,891,893 1/1990 Bowes, Jr. ..... 37/452 X
5,379,535 1/1995 Bowes, Jr. ..... 37/452

*Primary Examiner*—Terry Lee Melius
*Assistant Examiner*—Robert Pezzuto
*Attorney, Agent, or Firm*—Arthur G. Yeager

[57] ABSTRACT

An adapter assembly for an excavating cutterhead comprising the combination of a blade socket with a hemispherical recess, an adapter with a hemispherical-bottomed shaft to fit in the socket, and a mounting ring around the adapter head which can be indexed with respect to each other such that the adapter may be precisely replaced in an operating assembly without need to reorient the entire assembly. This is accomplished by means of mutually indexing each of the adapter and the mounting ring prior to the initial orientation of the assembly.

20 Claims, 2 Drawing Sheets

REPLACEABLE ADAPTER FOR EXCAVATING CUTTERHEAD

BACKGROUND OF THE INVENTION

Dredge cutterheads are generally conical with a multiplicity of hard rock cutting teeth or replaceable edges projecting outwardly from a plurality of spaced helical support vanes or blades disposed about its conical surface. The cutterhead normally has a hub which fits around a shaft and provides the torque which turns the cutterhead in its operation of dredging the bottom of waterways. The cutterhead encounters all kinds of material, including rock, which must be removed.

For the purpose of digging in rocky ground the cutterhead is fitted with teeth of high hardness and high impact properties;for the purpose of digging in soft to medium-soft ground the cutterhead is provided with edges of moderate hardness welded to the leading edge of the cutterhead blades. The service life of such welded edges is not as long as that of the hard teeth. The hard teeth extend radially a substantial distance ahead of the blade and do not perform efficiently in the soft-to-medium earth. Accordingly, it is most desirable to provide a cutterhead employing teeth of high hardness and wear resistance arranged in such a manner as to be efficient for digging in soft-to-medium soils and also to provide the advantages of easily replaceable forward edges.

The most common variety of replaceable tooth for a dredge cutterhead embodies a tapered shape which is attached by an adapter to the cutterhead blade such that the point of the taper is directed at the surface which is to be cut and the longitudinal axis of the tooth, generally passes through the centroid of the cutter blade section and is generally at an angle with respect to the profile plane of the cutterhead from the point of the tooth so as to provide an efficient transmission of power to the tooth with a minimum of breaking force. A replaceable tooth assembly is disclosed in U.S. Pat. No. 4,891,893, for example.

There is, of course, always the problem of realigning the tooth in the proper direction with respect to the cutterhead and welding the tooth into a fixed realignment. A novel assembly has been developed which permits a precise alignment for replacing the adapter, regardless of whether the adapter has been worn or broken.

It is an object of this invention to provide an improved assembly for mounting an adapter onto a cutterhead. It is another object of the invention to provide a system for accurately mounting an adapter and obtaining a desired alignment without special or laborious efforts. Still other objects will appear from the more detailed description which follows.

BRIEF SUMMARY OF THE INVENTION

This invention relates to a replaceable adapter assembly for an excavating cutterhead which includes the combination of a blade socket conically tapering from a larger open top to a smaller hemispherical bottom; an adapter having a body with a rearwardly projecting conical shaft tapering from the body to a smaller hemispherical bottom adapted to mate with the blade socket bottom, and having a forwardly projecting nose to mate with a recess in a digging tooth having a forward tip. An alignment ring is provided to fit snugly around the tapering shank adjacent to the adapter body, the adapter shank being smaller in radial size than the blade socket so as to permit a limited alignment of the tooth tip to its proper position. The alignment ring and the adapter shank have mutual indexing means to assure that a reassembly of a new adapter for a previously worn adapter into the ring can be made at exactly the same location to assure accurate location of the tooth tip.

In specific embodiments the indexing means includes mating flat spots, surfaces or notches on the adapter and the ring. In another embodiment the taper of the socket is about 5°–20° larger than the taper of the adapter shank.

In the method of this invention a welded assembly of a tooth, adapter, ring and blade socket is heated to break the weld between the adapter and the ring while leaving the welded connection between the ring and the blade socket intact. A new adapter can then replace the worn one, and the adapter aligned with the indexing spot or notch on the alignment ring and welded into place with the orientation of the tooth to the cutterhead blade automatically being the same as it was before being dissembled to accurately position the tip of the tooth on the cutterhead.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

This invention is best understood by reference to the attached drawings.

Figure 1:
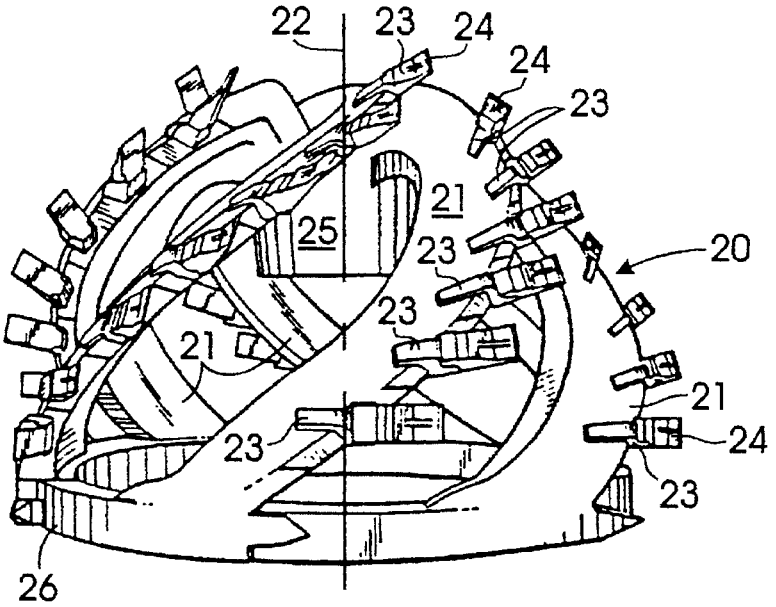
FIG 1 PRIOR ART
FIG. 1 is a front elevational view of an excavating cutterhead of the prior art.
Figure 2:
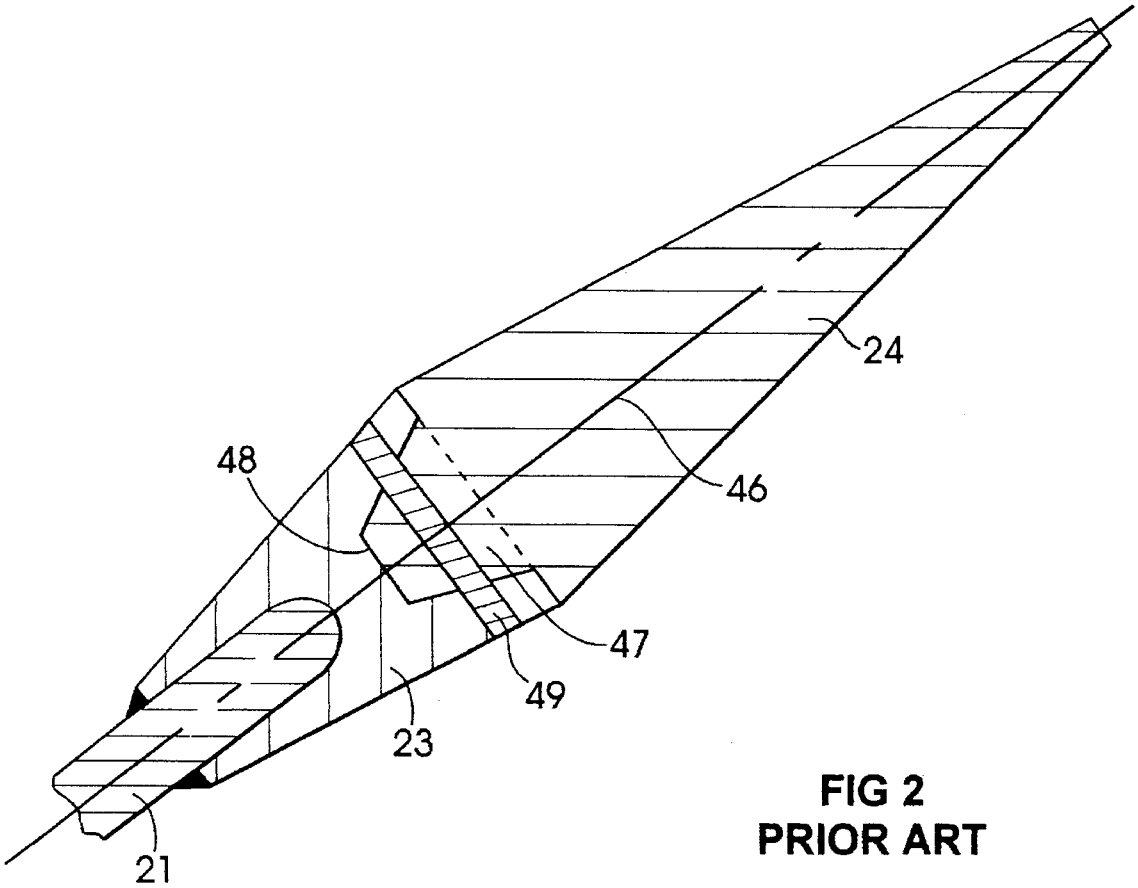
FIG 2 PRIOR ART
FIG. 2 is a longitudinal cross-section of a schematic assembly of an adapter and a tooth onto a blade of an excavating cutterhead of the prior art.

FIGS. 1–2 show the general state of the prior art of excavating cutterheads. A cutterhead 22 is mounted on the end of a long derrick framework such that the cutterhead 20 can be rotated around a length-wise axis 22 so as to permit projecting teeth 24 to dig into the ground (frequently underwater). Each tooth 24 is seated in an adapter 23 which, in turn, is mounted (usually by welding) onto a blade 21 of cutterhead 20. Several helical blades 21 extend from a central forward hub 25 to a rearward outer ring 26. Each tooth 24 is oriented in an individual direction by means of the orientation of the adapter when it is positioned and attached to a blade 21.

In general, an adapter 2 3, shown schematically in FIG. 2, is attached to a blade 21 by welding. There may be a certain amount of latitude in the precise direction in which the longitudinal axis 46 of tooth 24 and adapter 23 is positioned with respect to blade 21, depending on the material being excavated and the direction of the cut being made by the excavating machinery. In any event, an adapter 23 is normally welded to a blade 21 of the cutterhead, and the tooth 24 is attached to the adapter 23 by way of a tongue 47 in one component fitting into a recess 48 in the other component and the resulting juncture fastened securely by a key 49. It may also be that tooth 24 and adapter 23 are welded together. When a tooth 24 and/or an adapter 23 are worn, broken, or for other reason need to be replaced, it is a time-consuming job to melt the welds, remove the key, replace the necessary pieces, and reassemble the combination, being careful to orient the combination in the desired direction each time a replacement is needed. The present invention facilitates the job considerably by eliminating the reorientation step.

Figure 3:
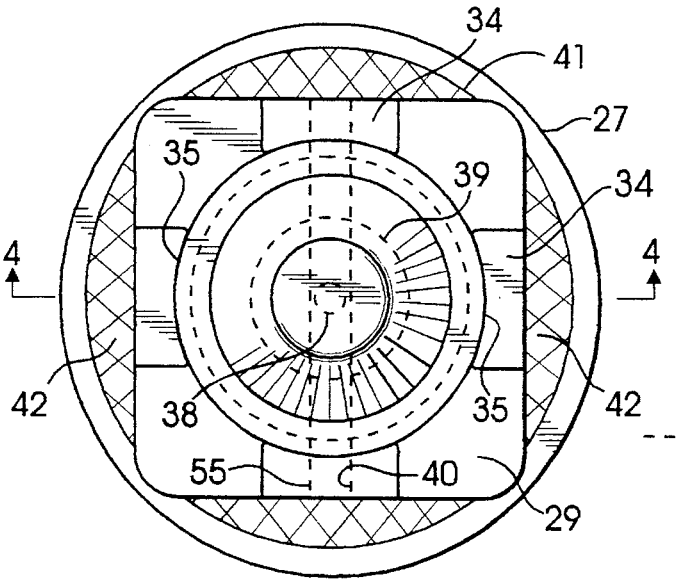
FIG. 3 is a top plan view of the assembly of a tooth, adapter, alignment ring, and blade socket of this invention.
Figure 4:
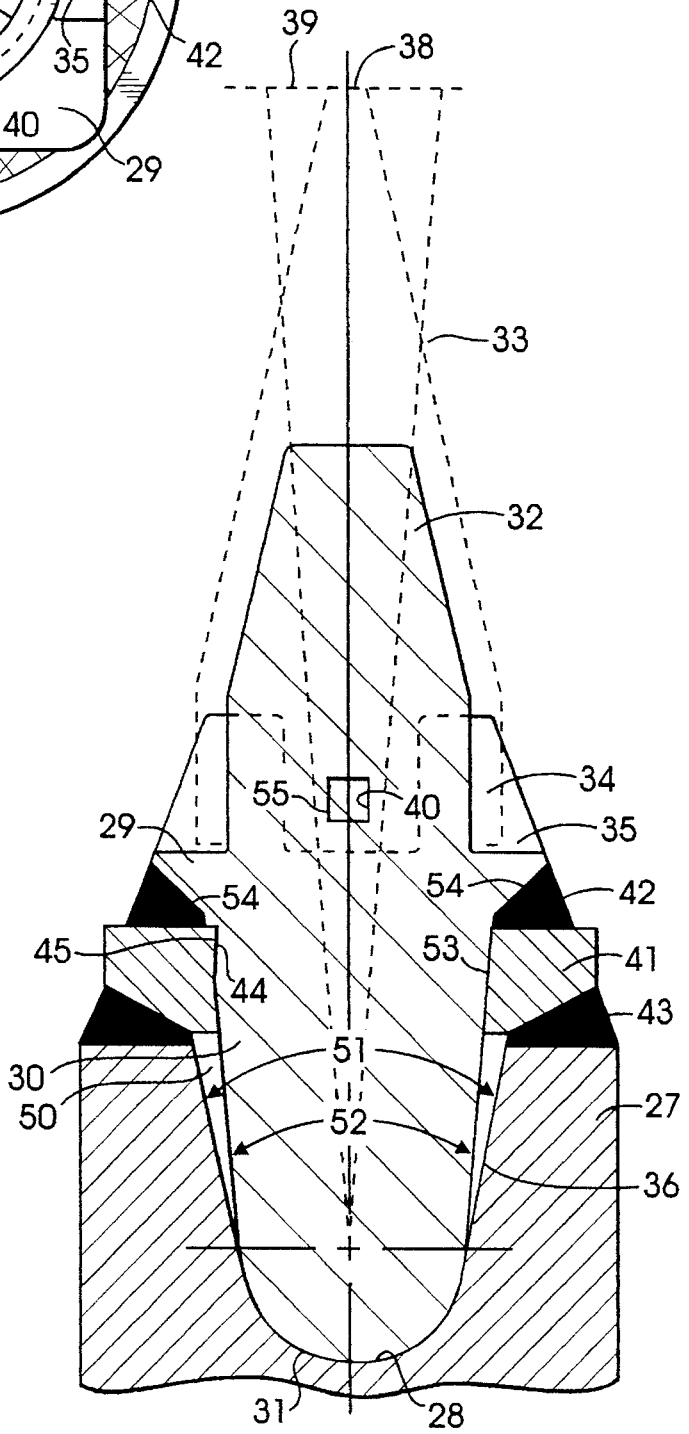
FIG. 4 is a cross-sectional view taken at 4—4 of FIG. 3.

In FIGS. 3–4 there is shown a novel combination of a tooth 33, an adapter 29, an alignment or adjustment collar or ring 41, and a blade socket 27. Blade socket 27 may be a component manufactured separate from the blade 21 (see FIG. 1) and later attached by welding or the blade can be manufactured originally with a plurality of sockets therein. The principal feature of blade socket 27 is a hemispherical socket or recess 28 which flares outwardly in a tapering or conical shape 36 to an opening. This hemispherical recess 28 forms a seat for a hemispherical bottom 31 on shank 30 which depends downwardly from the main central body of adapter 29. Hemispherical recess 28 and hemispherical bottom 31 preferably are geometrically identical so as to exactly conform or mate with each other, although some leeway is permissible in permitting hemispherical bottom 31 to be slightly smaller in radius than hemispherical recess, since it is necessary for bottom 31 to be rotatable in recess 28. The more snugly the fit between hemispherical bottom 31 and recess 28 the better will be the ability of the entire assembly to absorb the shocks and stresses of the excavation without breakage of teeth and adapters.

Each adapter 29 has a central body with a rearwardly projecting shank 30 and a forwardly projecting nose 32. Nose 32 is made to be the male portion of mating a fit with a corresponding recess in tooth 33. No particular shape is required. Passing completely through tooth 33 and adapter 29 is a keyway 40 to admit a key 55 to provide a firm connection between these two cooperating components. In the embodiment shown in FIGS. 3 and 4 the tooth 33 has depending flanges 34 which fit snugly into sockets 35 on the adapter 29.

The rearward end of adapter 29 is a tapering, conical shank 30 converging from a larger diameter at the central body of adapter 29 to a smaller diameter at hemispherical bottom 31. This arrangement then results in a smaller body of shank 30 inside a larger recess 36 leaving an annular space 50 which, in turn, provides some possibility of orienting tooth tip 38 throughout a circular adjustment zone 39. The respective sizes of shank 37 and recess 36 will dictate the size of zone 39. Generally, the included apex angle of recess 36 should be about 5–°20° larger than the included apex angle of shank 30.

Alignment collar or adjustment ring 41 is an annular ring having an inside conical surface to approximately match the outside conical surface of adapter shank 30. Collar 41 should be of a size to fit snugly against the outwardly flaring shoulder 54. The exact shape of the outside surfaces of collar 41 are not critical, but generally are shaped so as to provide a generous V-notch desirable for making a good weld since there is to be a weld 42 between the adapter 29 and the collar 41, and a weld 43 between the collar 41 and the blade socket 27. The upper face of adjustment ring 41 in contact with the adjacent face of adapter 23 makes a contact angle of 20°–α° ; and the lower face of adjustment ring 41 makes a contact angle of 20°–60° with the adjacent surface of the open top of the blade socket 27, as seen mast clearly in FIG. 4. On each collar 41 and adapter 29 there is an indexing means 44, 45 that mutually cooperate to provide a readily recognizable means for aligning these two components. The means normally are mating physical features, e.g., flat spots, notches, or the like, that can be mated by feel just prior to welding.

In operation when first assembling cutterhead blade sockets 27 are welded to cutterhead blades at approximate positions and pointed in approximate directions. Precision is not absolutely necessary, although reasonable care is taken to achieve approximate directions. The combination of an adapter 29 and an alignment collar 41 is then precisely oriented in the desired direction and welds 42 and 43 made to put these components in a firm connection to the cutterhead. Tooth 33 can then be attached by means of a key (not shown) through keyway 40.

When an adapter 29 wears out or becomes broken and must be replaced, weld 42 is burned out to permit the old adapter 29 to be removed and replaced by a new adapter. Weld 43 is not broken but remains in place connecting collar 41 to blade socket 27. The new adapter 29 can be rotated to find the appropriate location where the indexing means 44, 45 (flat spot or notch) meet, and weld 42 can immediately be filled in without further concern about orientation, because the original orientation remains in place between collar 41 and blade socket 27. This innovation saves considerable down time that would otherwise be spent making sure the replacement adapter 29 is properly oriented.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a replaceable adapter assembly for an excavating cutterhead the combination of a blade socket conically tapering from a larger open top to a smaller hemispherical bottom; an adapter having a body with a rearwardly projecting conical shank tapering from said body to a smaller hemispherical bottom adapted to mate with said blade socket bottom; said adapter having a forwardly projecting nose to mate with a recess in a digging tooth having a forward tip; and an adjustment ring fitting snugly around said conical shank adjacent said adapter body; said conical shank having a smaller tapering radial size than that of said blade socket to permit a limited radial adjustment of said tooth tip; indexing means between said adjustment ring and said conical shank for assuring reassembly of said adapter into said ring at exactly the same location once said adapter and said ring are separated; said ring being welded to said adapter and to said blade socket.

2. The adapter assembly of claim 1 wherein said blade socket bottom and said conical shank bottom are hemispherical and complementary in size and shape to closely interfit.

3. The adapter assembly of claim 1 wherein said mutual indexing means comprise mating flat spots on said adapter shank and on said adjustment ring.

4. The adapter assembly of claim 1 wherein said socket has a tapering apex angle 5°–20° larger than that of said conical shank.

5. The adapter assembly of claim 1 wherein said adjustment ring has an upper face in contact with said adapter and a lower face in contact with said open top of said blade socket.

6. The adapter assembly of claim 5 wherein said upper face makes a contact angle of 20°–60° with an adjacent surface of said adapter; and said lower face makes a contact angle of 20°–60° with an adjacent surface of said open top of said blade socket.

7. A process for replacing an old adapter in a welded assembly of adapter welded by a seam to an adjustment ring and blade socket and tooth in an excavating cutterhead wherein the old adapter and the adjustment ring were assembled with mutual indexing means in contact, which process comprises;

1. melt the welded seam in the assembly which connects an old adapter to an adjustment ring;
2. remove and replace the old adapter with a new adapter and align the mutual indexing means of the new adapter and the adjustment ring; and
3. weld the new adapter to the adjustment ring while maintaining the alignment of the mutual indexing means.

8. The process of claim 7 wherein the mutual indexing means comprise making flat spots on the old and new adapter and on the adjustment ring.

9. The adapter assembly of claim 1 wherein said hemispherical bottoms are substantially identical in size and shape so that loads may be transmitted from said tooth through said adapter via said hemispherical bottom of said shank into said hemispherical bottom of said blade socket into said blade of said cutterhead, said mutual indexing means includes flat spots on each said adapter shank and said adjustment ring which are complementary and mate to accurately align a replacement adapter to said mounting ring after removal of said adapter due to excessive wear or breakage thereof.

10. The adapter assembly of claim 9 wherein said adjustment ring has an upper face facing said adapter and a lower face facing said open top of said blade socket with circumferential grooves formed therebetween and welds respectively filling said grooves.

11. A replaceable adapter assembly for an excavating cutterhead comprising a blade socket conically tapering from a larger open top to a smaller hemispherical bottom, an adapter having a body with a rearwardly projecting conical shank tapering from said body to a smaller hemispherical bottom adapted to mate with said blade socket bottom, said adapter having a forwardly projecting nose to mate with a recess in a digging tooth having a forward tip, an adjustment ring fitting snugly around said conical shank adjacent said conical body, said adapter shank having a smaller tapering radial size than that of said blade socket to permit a limited radial adjustment of said tooth tip; said ring being welded to each of said adapter and to said blade socket thereby affixing said adapter firmly to said blade socket with its correct pitch and angularity.

12. The adapter assembly of claim 11 further comprising indexing means between said adjustment ring and said adapter shank to assure reassembly of said adapter into said ring at exactly the same location once said adapter and said ring are separated for replacement of said adapter.

13. The adapter assembly of claim 11 wherein said socket bottom and said shank bottom are hemispherical and substantially identical in size and shape to support said shank bottom nestingly within said socket bottom.

14. The adapter assembly of claim 11 wherein said indexing means comprise mating flat surfaces on said adapter shank and on said adjustment ring.

15. The adapter assembly of claim 11 wherein said socket has a tapering apex angle 5°–20° larger than that of said conical shank.

16. The adapter assembly of claim 11 wherein said adjustment ring has an upper face facing said adapter and a lower face facing said open top of said blade socket with circumferential grooves formed therebetween and welds respectively filling said grooves.

17. The adapter assembly of claim 5 wherein said upper face makes a contact angle of 20°–60° with an adjacent surface of said adapter, and said lower face makes a contact angle of 20°–60° with an adjacent surface of said open top of said blade socket.

18. A method for relacing an old adapter with a new adapter in a welded assembly of old adapter welded by a seam to an adjustment ring and blade socket welded by another seam to a blade in an excavating cutterhead wherein the old adapter and the adjustment ring were assembled with mutual indexing means in contact, which method comprises the steps of:

A. melt the welded seam in the assembly which connects the old adapter to the ring;

B. remove and replace the old adapter with a substantially identical new adapter;

C. align the mutual indexing means between the new adapter and the ring;

D. weld the new adapter to the ring while maintaining the alignment of the mutual indexing means.

19. The method of claim 18 further comprising the step of:

E. maintaining the welded seam in assembly which connects the ring to the blade in unmelted condition while performing the steps of A and B.

20. The method of claim 18 wherein said mutual indexing means includes a flat surface on each of the adjustment ring and old adapter, said method includes the step of;

E. making a flat surface on the new adapter as the corresponding flat surface on the old adapter to mate with the flat surface on the adjustment ring.

* * * * *